United States Patent [19]

Markus

[11] 4,373,899

[45] Feb. 15, 1983

[54] FUEL REACTOR

[75] Inventor: Gerardus A. Markus, Gravenzande, Netherlands

[73] Assignee: Black, Sivalls & Bryson, Houston, Tex.

[21] Appl. No.: 257,273

[22] Filed: Apr. 24, 1981

[30] Foreign Application Priority Data

Jun. 17, 1980 [GB] United Kingdom ..... 8019826

[51] Int. Cl.[3] ..... F23D 15/00

[52] U.S. Cl. ..... 431/158; 431/351

[58] Field of Search ..... 431/158, 351, 352

[56] References Cited

U.S. PATENT DOCUMENTS 3,016,703 1/1962 Lorett et al. ..... 431/158

3,720,497 3/1973 Arenson ..... 431/353

FOREIGN PATENT DOCUMENTS 137751 9/1979 Fed. Rep. of Germany ..... 431/351

*Primary Examiner*—Carroll B. Dority, Jr.

*Attorney, Agent, or Firm*—Vinson & Elkins

[57] ABSTRACT

A fuel reactor having an outer frusto-conical shell which is closed at one axial end and a fuel inlet at this axial end projects fuel axially into the outer shell and into an inner shell mounted coaxially therewith, the inner and outer shells being connected together at the discharge end of the inner shell, with the inner shell being open at its other end and axially spaced from the closed end of the outer shell. A tangential combustion air inlet is connected to the annular space between the two shells while a discharge nozzle is mounted on the discharge end of the inner shell. A number of circumferentially spaced tangential slots in the inner shell adjacent the nozzle scoop up some of the swirling air projected in through the tangential air inlet and direct some of the air onto the outer surface of the discharge nozzle so that it is cooled.

12 Claims, 6 Drawing Figures

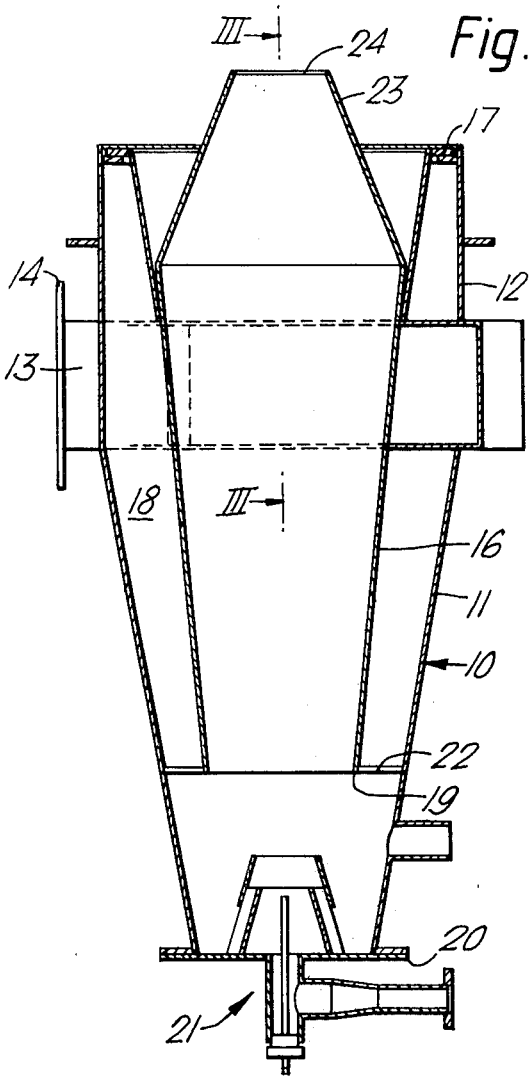
Fig. 1.
Fig. 4.
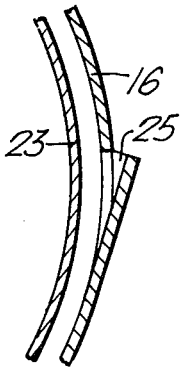

FUEL REACTOR

DESCRIPTION

The present invention relates to fuel reactors.

Various forms of fuel reactors, or high intensity burners, are known. It has been proposed to have a high intensity burner including an outer shell which is of generally circular cross-section, and usually frusto-conical, with a fuel inlet being provided at one end, usually the lower end so that fuel is projected axially into the shell. An inner shell is mounted within the outer shell, with its lower end spaced from the inlet end of the outer shell, and its peripheral wall spaced from the wall of the outer shell to provide an annular space into which combustion air is forced by way of a tangential combustion air inlet. The combustion air swirls downwardly, and combines with the fuel that is ignited, and the products of combustion are discharged through a discharge nozzle at the upper end of the inner shell.

While such reactors or burners are generally satisfactory, there are certain problems involved in overheating, in stability of operation and sluggish response to rapid changes in the heat load.

It is now proposed, according to the present invention, to provide a fuel reactor comprising a generally circular cross-section elongate outer shell, closed at one axial end, a fuel inlet at said one axial end adapted to project fuel axially into said outer shell, an inner shell mounted within said outer shell to define an annular space therebetween, the inner and outer shells being connected together at a discharge end of the inner shell, the other end of the inner shell being open and axially spaced from the closed end of the outer shell, a tangential combustion air inlet connected to the annular space at an axial location spaced from said other end of the inner shell, a discharge nozzle mounted on the discharge end of the inner shell and at least one opening in the inner shell adjacent the discharge nozzle communicating with the annular space, to allow some of the air to flow onto the exterior of the discharge nozzle to cool it.

With such a construction, the problem of overheating is largely overcome, because a proportion of the air which enters via the tangential combustion air inlet is bled off and is discharged through the opening or openings against the exterior surface of the discharge nozzle, thereby cooling the discharge nozzle.

Preferably there are a plurality of these openings, for example six, in the inner shell and these are circumferentially spaced around the nozzle.

In one construction, such openings are in the form of tangential slots in the inner shell, these being angled in the same sense as the tangential combustion air inlet, whereby a portion of the air swirling in the annular space as a result of entering via the air inlet is scooped up by the slots and flows readily onto the exterior surface of the nozzle.

The outer shell may be provided with a radially inwardly directed support ring at the end which is remote from the fuel inlet while the inner shell is provided with a radially outwardly directed flange at its discharge end, the flange abutting the support ring to connect the inner and outer shells. If the inner axial face of the flange engages the outer axial face of the support ring, the inner shell, together with the nozzle can readily be removed by lifting upwardly. This is greatly facilitated if the inner shell is of frusto-conical form, diverging towards the outlet or discharge end.

The outer shell is advantageously closed by a base plate having a fuel inlet aperture therein and a first frusto-conical inlet cone is mounted on this base plate to surround the fuel inlet aperture, a second frusto-conical inlet cone being mounted coaxially with the first and spaced therefrom, whereby a portion of the combustion air can flow through the annular space between the first and second inlet cones, to premix with fuel entering at the fuel inlet aperture.

This will ensure a very thorough mixing of the combustion air with the fuel, and the noise generated by the reactor under normal operating conditions can be very low, as compared with conventional reactors, in this instance being below 80 dB. It has been found that the arrangement also ensures that the flame is held at the base of the inner cone, which gives good combustion characteristics.

A particularly stable arrangement can be provided when the second inlet cone is mounted on the first inlet cone by means of a plurality of circumferentially spaced vanes, which preferably extend in radial planes with respect to the axis of the cores. The second inlet cone then preferably overlaps the first inlet cone, so that the portion of combustion air has an axial component of velocity as it passes through the annular space to enter the second inlet cone.

A pilot burner may extend axially through the inlet aperture to a location within the first inlet cone and it has been found that the pilot flame, in such an arrangement, is very stable for the full range of combustion air flows.

Preferably the first cone includes at least one flame arrestor screen and a spark igniter and/or a flame detector, for example a ultra-violet flame detector may be provided within the first cone.

In order that the present invention may more readily be understood, the following description is given, merely by way of example, reference being made to the accompanying drawings, in which:

FIG. 1 is a longitudinal cross-section through one embodiment of fuel reactor according to the present invention;

FIG. 4 is an enlarged scrap section taken along the line IV—IV of FIG. 3.

Figure 2:
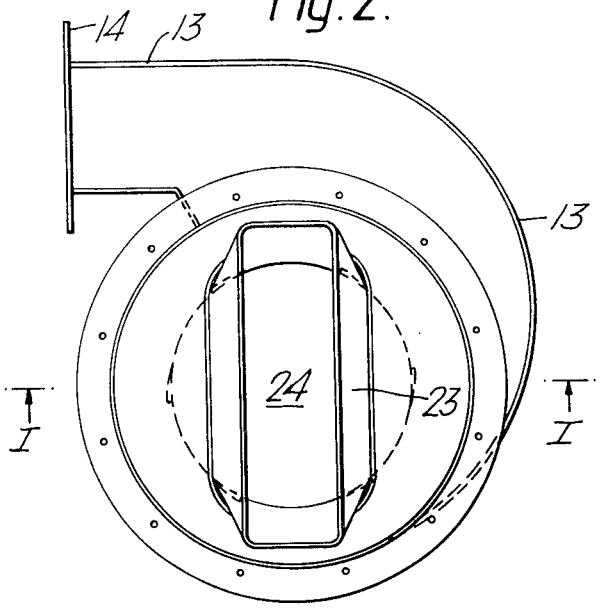
FIG. 2 is a top plan view of the reactor of FIG. 1.

Referring first to FIGS. 1 and 2, there is indicated a fuel reactor comprising an outer circular cross-section shell indicated by the reference numeral 10 having a frusto-conical lower portion 11 surmounted by a cylindrical portion 12. A tangentially arranged combustion air inlet 13 is connected to the lower part of the cylindrical portion 12 and terminates in a fixing flange 14 for securing to a suitable blower discharge. At its upper end the outer shell cylindrical portion 12 has a radially inwardly directed support ring 15 welded thereto. An inner shell 16, of generally frusto-conical upwardly divergent form has a radially outwardly extending flange 17 which rests on and is supported by the ring 15 of the outer shell, the ring 15 and flange 17 together closing the annular space 18 formed between the inner and outer shells 11 and 16.

At its lower end 19 the shell is spaced axially from a base plate 20 which is secured to the lower end of the outer shell 11. A fuel inlet assembly is indicated by the general reference numeral 21 and will be described in more detail later. Suffice it to say, for the present, the fuel inlet assembly 21 projects fuel, usually gaseous fuel, into the inner shell 16 along the axis thereof. A spider 22 maintains the lower end 19 of the inner shell 16 away from the wall of the outer shell 11, and permits combustion air, which is blown in through the tangential combustion air inlet 13, to swirl downwardly and act as the combustion air for the fuel.

Figure 3:
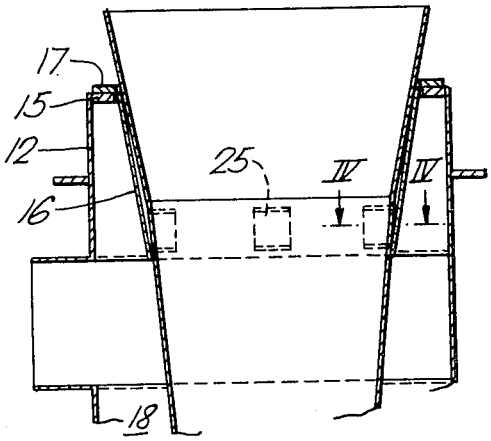
FIG. 3 is a section taken along the line III—III of FIG. 1.

At its upper end, the inner shell 16 is provided with a fishmouth discharge nozzle 23 which may be made of ceramic material and is wider in one direction than the other, as can be seen in particular from FIG. 2 and also from FIGS. 1 and 3. The shape of this nozzle is such that the products of combustion fan out as they leave the outlet orifice 24 at the upper end of the nozzle 23.

In the vicinity of the lower portion of the nozzle 23, the wall of the inner shell 16 is provided with six equiangularly circumferentially spaced openings in the form of slots 25, the construction of which can be seen more readily from FIG. 4. In FIG. 4 the slots 25 are shown as punched out from the metal of the inner shell 16. The could, however, be formed by cutting holes in the shell 16 and providing an overlying deflector plate. The slots 25 are tangentially disposed in the same sense as the tangential disposition of the combustion air inlet 13, so that a proportion of the air which is blown in at 13 will be "scooped" by the slots 25 and projected onto the exterior surface of the nozzle 23 thus cooling it significantly. It has been found that heat conduction and radiation to the outer surfaces of the reactor are very significantly reduced so that the reactors may be expected to have a longer operational life and greater mechanical integrity than known reactors of this type.

Since the inner shell 16 is supported in the manner indicated by the flange 17 and support ring 15, expansion of the reactor is readily accommodated so that the reactor is able to respond quickly to rapid changes in heat load and find particular application in regeneration heaters.

Figure 5:
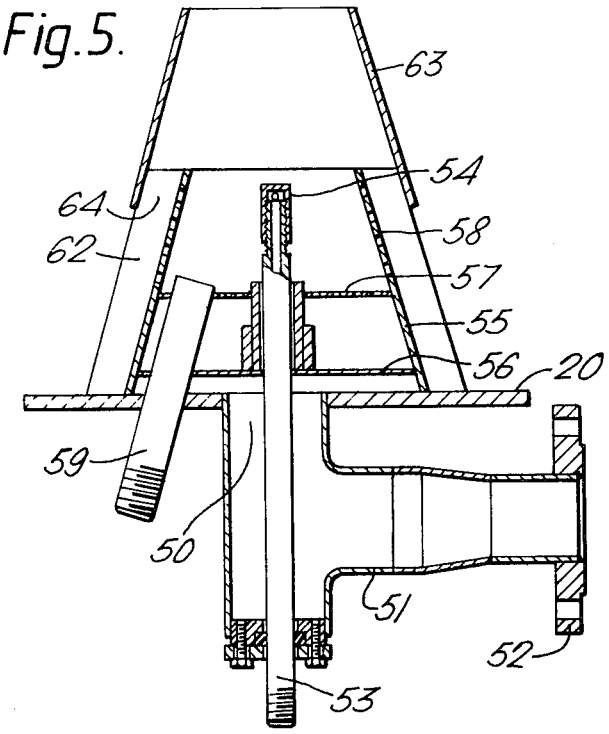
FIGS. 5 and 6 are respectively an enlarged cross-section through, and a plan of, the base plate of the reactor of FIG. 1, with the fuel inlet assembly mounted thereon.
Figure 6:
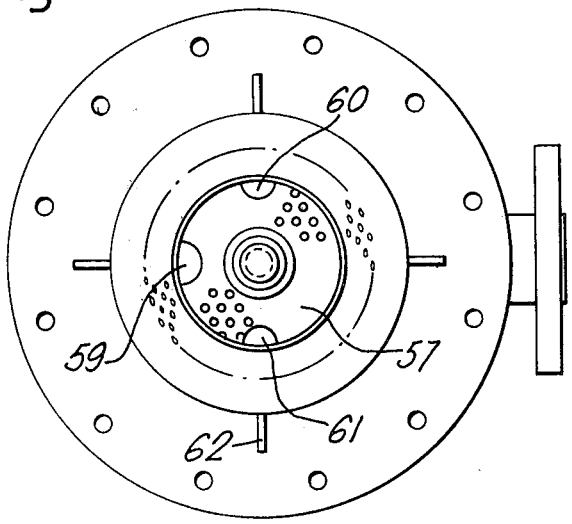

A preferred construction of the fuel inlet assembly is illustrated in more detail in FIG. 5. The base plate 20 is provided with a central fuel inlet opening 50 over which is fitted a T cross-section fuel inlet pipe 51 connectable, by flange 52, to a source of fuel. Extending along the cross of the T is the feed tube 53 of a pilot burner 54.

Mounted coaxially with the opening 50 is an inner cone 55 of upwardly convergent frusto-conical form, the lower edge of this cone 55 being secured to the base plate 20. Within the inner cone is a support plate 56 which actually carries the pilot burner 54. About halfway along its length the inner cone is provided with a perforated flame arrestor plate 57.

While the lower portion of the cone 55 is of imperforate construction, the upper portion 58, above the arrestor plate 57 is itself perforated.

Angled along the line of inclination of the cone 55 and circumferentially spaced from one another, are an igniter, for example a spark igniter, 59, a flame rod 60 and a UV detector 61, the tips of these all extending above the flame arrestor plate 57.

Welded to the exterior wall of the inner cone 55 are four equi-angularly spaced vanes 62, the vanes 62 each extending in a radial plane with respect to the axis of the inner cone. Coaxially mounted with respect to the inner cone is an outer cone 63 which is welded to the vanes 62 and provides therewith an annular air space 64.

In operation, the pilot burner can be ignited, when gas is applied through the pipe 53 by means of the igniter 59. When the main gas supply is fed in through flange 52 and pipe 51, it passes through opening 50 and into the inner cone and is ignited by the pilot flame. Combustion air for the pilot flame is provided by air flowing radially inwardly through the perforations in the upper portion 58 of the inner cone. Some combustion of air for the flame of the main burner is fed in via the annular space 64 between the lower edge of the outer cone and the upper edge of the lower or inner cone. This will only be a proportion of the total amount of combustion air for the main burner, the remaining combustion air arriving in the space between the top edge of the outer cone 63 and the lower edge 19 of the inner shell 16.

It will be appreciated that some premixing of the fuel gas can thus be achieved by the combustion air flowing in through the annular space 64. This flow is oriented by the vanes 62 thus giving the air an axial component of velocity as it flows into the outer cone 63.

It has been found that this arrangement provides a very stable pilot and also good combustion characteristics. It has also been found that the noise generated by the reactor, under normal operating conditions, is relatively low, and is typically below 80 dB.

It is believed that the good combustion characteristics can be achieved because the flame is, in effect, held at the base of the inner shell 16.

I claim:

1. A fuel reactor comprising, in combination:

(a) a generally circular cross-section elongate outer shell having an inlet axial end and an outlet axial end opposite thereto;

(b) an end wall closing said outer shell at said inlet end;

(c) a fuel inlet in said end wall and adapted to project fuel axially into said outer shell;

(d) an inner shell mounted within said outer shell to define an annular space therebetween;

(e) means connecting the inner and outer shells together at said discharge end of the inner shell;

(f) an open end at the other end of the inner shell axially spaced from said end wall of the outer shell;

(g) a tangential combustion air inlet connected to the annular space at an axial location spaced from said other end of the inner shell;

(h) a discharge nozzle mounted on the discharge end of the inner shell; and (i) at least one opening in the inner shell adjacent the discharge nozzle communicating with the annular space, to allow some of the air to flow onto the exterior of the discharge nozzle to cool it.

2. A fuel reactor as claimed in claim 1, wherein there are a plurality of openings in said shell at circumferentially spaced locations around said nozzle.

3. A fuel reactor as claimed in claim 1, wherein said at least one opening is in the form of a tangential slot in the inner shell, angled in the same sense as the tangential combustion air inlet, whereby a portion of the air swirling in the annular space as a result of entering via the air inlet, is scooped up and flows readily onto the exterior of the nozzle.

4. A fuel reactor as claimed in claim 1, wherein the outer shell further comprises a radially inwardly directed support ring at the end remote from the fuel inlet and the inner shell further comprises a radially outwardly directed flange at the discharge end, the flange abutting the support ring effective to connect the inner and outer shells.

5. A fuel reactor as claimed in claim 4, wherein the inner axial face of the flange engages the outer axial face of the support ring.

6. A fuel reactor as claimed in claim 1, wherein the inner shell is of frusto-conical form, diverging towards the discharge end.

7. A fuel reactor as claimed in claim 1, wherein the end wall of the outer shell comprises a base plate having a fuel inlet aperture therein and further comprises a first frusto-conical inlet cone mounted on said base plate to surround said fuel inlet aperture with the wider end of the first cone adjacent said base plate and a second frusto-conical inlet cone is mounted coaxially with and spaced from said first cone, the wider end of the second cone facing the base plate and being spaced therefrom, whereby a portion of combustion air can flow from said outer shell through the annular space between said first and second inlet cones, to premix with fuel entering at said fuel inlet aperture and whereby the remainder of the combustion air mixes with the fuel between the second cone and the open end of the inner shell.

8. A fuel reactor as claimed in claim 7, and further comprising a plurality of circumferentially spaced vanes.

9. A fuel reactor as claimed in claim 8, wherein the vanes extend in radial planes with respect to the axis of said cones.

10. A fuel reactor as claimed in claim 7, wherein the second inlet cone overlaps the first cone, whereby said portion of the combustion air has an axial component of velocity as it passes through the annular space to enter the second inlet cone.

11. A fuel reactor as claimed in claim 7, and further comprising a pilot burner extending axially through the inlet aperture to a location within said first inlet cone.

12. A fuel reactor as claimed in claim 11, wherein at least a portion of said first cone is perforated to allow some combustion air to enter the first inlet cone for the pilot burner.

* * * * *